US009939772B2

(12) United States Patent
Murata

(10) Patent No.: US 9,939,772 B2
(45) Date of Patent: Apr. 10, 2018

(54) IMAGE FORMING APPARATUS, TONER CONTAINER ATTACHABLE TO IMAGE FORMING APPARATUS

(71) Applicant: KYOCERA Document Solutions Inc., Osaka-shi, Osaka (JP)

(72) Inventor: Koji Murata, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/422,331

(22) Filed: Feb. 1, 2017

(65) Prior Publication Data

US 2017/0219986 A1 Aug. 3, 2017

(30) Foreign Application Priority Data

Feb. 3, 2016 (JP) ..... 2016-019002

(51) Int. Cl.
*G03G 15/08* (2006.01)
*G03G 21/16* (2006.01)
*G03G 15/00* (2006.01)

(52) U.S. Cl.
CPC ..... *G03G 15/80* (2013.01); *G03G 15/0865* (2013.01); *G03G 15/0872* (2013.01); *G03G 15/0879* (2013.01); *G03G 2215/0665* (2013.01); *G03G 2215/0668* (2013.01)

(58) Field of Classification Search
CPC ..... G03G 2215/0695
See application file for complete search history.

(56) References Cited

U.S. PATENT DOCUMENTS 4,803,521 A * 2/1989 Honda ..... G03G 21/1896 399/111
5,049,930 A * 9/1991 Okano ..... G03G 15/0126 399/12
5,392,102 A * 2/1995 Toyoizumi ..... G03G 15/0879 399/223
5,761,566 A * 6/1998 Suzuki ..... B41J 2/17546 399/12

(Continued)

FOREIGN PATENT DOCUMENTS

JP 2010032594 A 2/2010

*Primary Examiner* — Clayton E Laballe
*Assistant Examiner* — Leon W Rhodes, Jr.
(74) *Attorney, Agent, or Firm* — Alleman Hall Creasman & Tuttle LLP

(57) ABSTRACT

An image forming apparatus includes a toner container, a container attachment portion, and a control portion. The toner container has a coupling portion. The container attachment portion includes a coupled portion that includes a first key member. A second key member of the coupling portion is formed at position where it does not interfere with the first key member in attachment state. The second key member is made of insulator. The coupled portion includes a contact terminal in which a contact is opened by the second key member and becomes OFF state when the toner container is inserted to attachment position, and the contact is closed and becomes ON state when the toner container is removed from the attachment position. The control portion detects the toner container attached to the container attachment portion when the contact of the contact terminal changes from the ON state to the OFF state.

7 Claims, 11 Drawing Sheets

(56) References Cited

U.S. PATENT DOCUMENTS

| | | | | |
|---|---|---|---|---|
| 6,023,594 | A * | 2/2000 | Okiyama | G03G 15/0872 399/112 |
| 6,263,170 | B1 * | 7/2001 | Bortnem | B41J 2/17503 399/13 |
| 6,285,836 | B1 * | 9/2001 | Kubota | G03G 21/1896 399/12 |
| 6,347,195 | B1 * | 2/2002 | Saiki | B41J 2/17503 399/12 |
| 7,302,196 | B2 * | 11/2007 | Nakashima | G03G 15/0863 399/12 |
| 2006/0115291 | A1 * | 6/2006 | Chung | G03G 21/1867 399/90 |
| 2007/0269224 | A1 * | 11/2007 | Sato | G03G 15/0863 399/12 |

* cited by examiner

IMAGE FORMING APPARATUS, TONER CONTAINER ATTACHABLE TO IMAGE FORMING APPARATUS

INCORPORATION BY REFERENCE

This application is based upon and claims the benefit of priority from the corresponding Japanese Patent Application No. 2016-019002 filed on Feb. 3, 2016, the entire contents of which are incorporated herein by reference.

BACKGROUND

The present disclosure relates to an image forming apparatus that includes a container attachment portion for supporting, in an attachable/detachable manner, a toner container having an attachment compatibility therewith, and relates to a toner container that can be attached to an image forming apparatus.

A developing device is mounted in an image forming apparatus of an electrophotographic system. The developing device stores, in its inside, developer that includes toner. The image forming apparatus includes a container attachment portion to which a toner container is attached. When the toner container is attached to the container attachment portion, the toner can be supplied from the toner container to the developing device.

There is known a conventional image forming apparatus that includes a detection mechanism configured to detect a toner container disposed at a predetermined position on the container attachment portion. The detection mechanism of the image forming apparatus includes a movable member that slides only when a predetermined toner container is inserted, in conjunction with an insertion of the toner container. This makes it possible not only to detect the toner container, but also to discriminate the toner container that matches the container attachment portion.

Meanwhile, there is known an image forming apparatus having an incompatibility structure where only a toner container having attachment compatibility can be attached to the container attachment portion, so that inappropriate toner cannot be supplied to the container attachment portion. In this type of image forming apparatus, a main-body-side compatible key that corresponds to a toner container that can be attached to a container attachment portion, is provided on the container attachment portion. On the other hand, a container-side compatible key is provided on the toner container, wherein the container-side compatible key can be engaged with only the main-body-side compatible key of the container attachment portion that corresponds to the toner container, and cannot be engaged with other container attachment portions.

SUMMARY

An image forming apparatus according to an aspect of the present disclosure includes a toner container, a container attachment portion, and a control portion. The toner container has a coupling portion on a tip thereof. The container attachment portion supports the toner container such that the toner container is inserted toward a predetermined attachment position and is attached thereto at the attachment position. The control portion, upon detection of the toner container attached to the container attachment portion, makes an image forming operation executable. The container attachment portion includes a coupled portion that includes at least one first key member that protrudes toward the toner container. The coupling portion includes at least one second key member. The second key member is formed at a position where it does not interfere with the first key member in an attachment state where the toner container is attached to the container attachment portion. The second key member is made of an insulator and projects in an insertion direction directing toward the attachment position. The coupled portion includes a contact terminal in which a contact is opened by the second key member and becomes an OFF state when the toner container is inserted to the attachment position, and the contact is closed and becomes an ON state when the toner container is removed from the attachment position. The control portion detects the toner container attached to the container attachment portion when the contact of the contact terminal changes from the ON state to the OFF state.

A toner container according to another aspect of the present disclosure is configured to be attachable to and detachable from a container attachment portion of an image forming apparatus. The container attachment portion includes a storage portion, a coupled portion, and a contact terminal, the storage portion storing the toner container that is inserted toward a predetermined attachment position, the coupled portion including at least one first key member that protrudes toward the toner container, the contact terminal being provided on the coupled portion and in a normal time, a contact of the contact terminal being closed and maintaining an ON state. The toner container includes a coupling portion that is engaged and coupled with the coupled portion at the attachment position. The coupling portion includes at least one second key member that is formed at a position where it does not interfere with the first key member in an attachment state where the toner container is attached to the container attachment portion, the second key member being made of an insulator and projecting in an insertion direction directing toward the attachment position. When the toner container is inserted to the attachment position, the contact is opened by the second key member and becomes an OFF state, and when the toner container is removed from the attachment position, the contact is closed and becomes an ON state.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an image forming apparatus 10 with reference to the drawings. In the following description, a vertical direction in an installed state of the image forming apparatus 10 is defined as an up-down direction D1. In addition, a front-rear direction D2 is defined on a supposition that a side from which a toner container 41 is inserted to the image forming apparatus 10 is a front side. Furthermore, a left-right direction D3 is defined by viewing the image forming apparatus 10 from the front side.

[Image Forming Apparatus]

The image forming apparatus 10 has at least a print function and is, for example, a color printer. The image forming apparatus 10 prints an image on a print sheet that is a sheet member, by using developer containing toner. It is noted that a specific example of the image forming apparatus 10 is, for example, a printer, a copier, a facsimile, or a multifunction peripheral having functions of these apparatuses. In addition, although the image forming apparatus 10 is one that can form a color image, the image forming apparatus may be one that can form a monochrome image as far as it uses the toner container 41.

Figure 1:
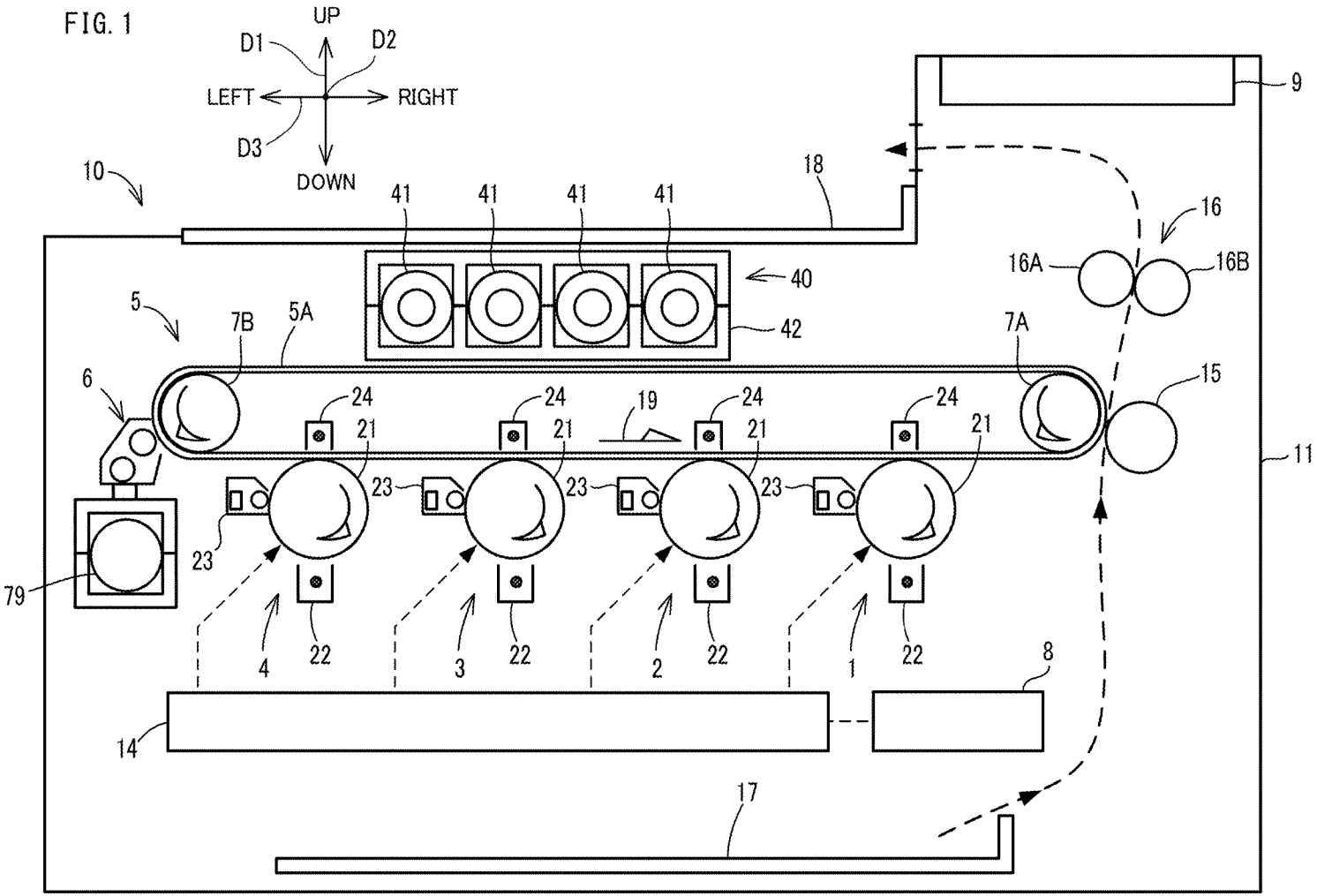
FIG. 1 is a diagram showing a configuration of an image forming apparatus according to an embodiment of the present disclosure.

As shown in FIG. 1, the image forming apparatus 10 is a so-called tandem-system color image forming apparatus. The image forming apparatus 10 includes a plurality of image forming portions 1 to 4, an intermediate transfer unit 5, an exposure device 14, a secondary transfer device 15, a fixing device 16, a toner supply device 40, a belt cleaning device 6, an operation/display portion 9 including a touch panel, a liquid crystal display portion and the like, a control portion 8, a sheet feed tray 17, and a sheet discharge tray 18. These components are attached to a housing 11 that constitutes an external frame (not shown), an internal frame and the like of the image forming apparatus 10.

The image forming portions 1 to 4 form, by a so-called electrophotographic system, toner images of different colors respectively on a plurality of photoconductor drums 21 that are arranged in alignment. The toner images are transferred to an intermediate transfer belt 5A while it is running (moving) such that the toner images are overlaid with each other thereon. In the example shown in FIG. 1, an image forming portion 1 for black, an image forming portion 2 for yellow, an image forming portion 3 for cyan, and an image forming portion 4 for magenta are arranged in alignment in the stated order from the downstream side in the moving direction (direction indicated by the arrow 19) of the intermediate transfer belt 5A.

The image forming portions 1 to 4 are provided below the intermediate transfer belt 5A. Each of the image forming portions 1 to 4 includes a photoconductor drum 21 carrying a toner image thereon, a charging device 22, a developing device 23, and a primary transfer device 24. The surface of the photoconductor drum 21 is charged by the charging device 22, and the charged surface of the photoconductor drum 21 is exposure-scanned by the exposure device 14. This allows an electrostatic latent image to be formed on the surface of the photoconductor drum 21. The developing device 23 develops the electrostatic latent image with the toner. Subsequently, the toner image on the photoconductor drum 21 is transferred to the intermediate transfer belt 5A by the primary transfer device 24.

The intermediate transfer unit 5 includes the intermediate transfer belt 5A, a driving roller 7A, and a driven roller 7B. The intermediate transfer belt 5A carries a toner image that is formed from toner images of a plurality of (in the present embodiment, four) colors. The intermediate transfer belt 5A is supported and rotationally driven by the driving roller 7A and the driven roller 7B so as to move while its surface is in contact with surfaces of the photoconductor drums 21. When the intermediate transfer belt 5A is rotationally driven, its surface passes between the photoconductor drums 21 and the primary transfer devices 24. During that movement, the toner images of the different colors carried on the plurality of photoconductor drum 21 are transferred in sequence to the intermediate transfer belt 5A in such a way as to be overlaid with each other thereon.

The toner supply device 40 is provided above the intermediate transfer unit 5. The toner supply device 40 includes a container attachment portion 42 to which four toner containers 41 for colors of black, yellow, cyan, and magenta are attached. The container attachment portion 42 is configured such that the toner containers 41 are attachable thereto and detachable therefrom. The configuration of the toner supply device 40 is described below.

The secondary transfer device 15 transfers the toner image from the intermediate transfer belt 5A to a print sheet conveyed from the sheet feed tray 17. The print sheet on which the toner image has been transferred is conveyed by a conveyance portion (not illustrated) to the fixing device 16. The fixing device 16 includes a heating roller 16A and a pressure roller 16B. The fixing device 16 conveys the print sheet on which the toner image has been transferred, while applying heat and pressure thereto. This allows the toner image to be fused and fixed to the print sheet. The print sheet to which the toner image has been fixed is further conveyed to the downstream side, and discharged to and held by the sheet discharge tray 18 that is disposed above the intermediate transfer unit 5.

The belt cleaning device 6 collects waste toner, namely toner that has remained on the surface of the intermediate transfer belt 5A, and conveys the collected waste toner to a waste toner container 79.

The control portion 8 comprehensively controls an image forming operation in the image forming apparatus 10. The control portion 8 includes CPU, ROM, RAM and the like. In the present embodiment, the control portion 8 detects toner containers 41 attached to the container attachment portion 42 of the toner supply device 40, and only when it has detected toner containers 41, the control portion 8 makes the image forming operation executable in the image forming apparatus 10. For example, by causing the CPU to execute a process in accordance with a control program stored in the ROM or the like, the control portion 8 performs the detection of the toner containers 41 in the container attachment portion 42 and the control of the image forming operation.

[Toner Supply Device]

Figure 2:
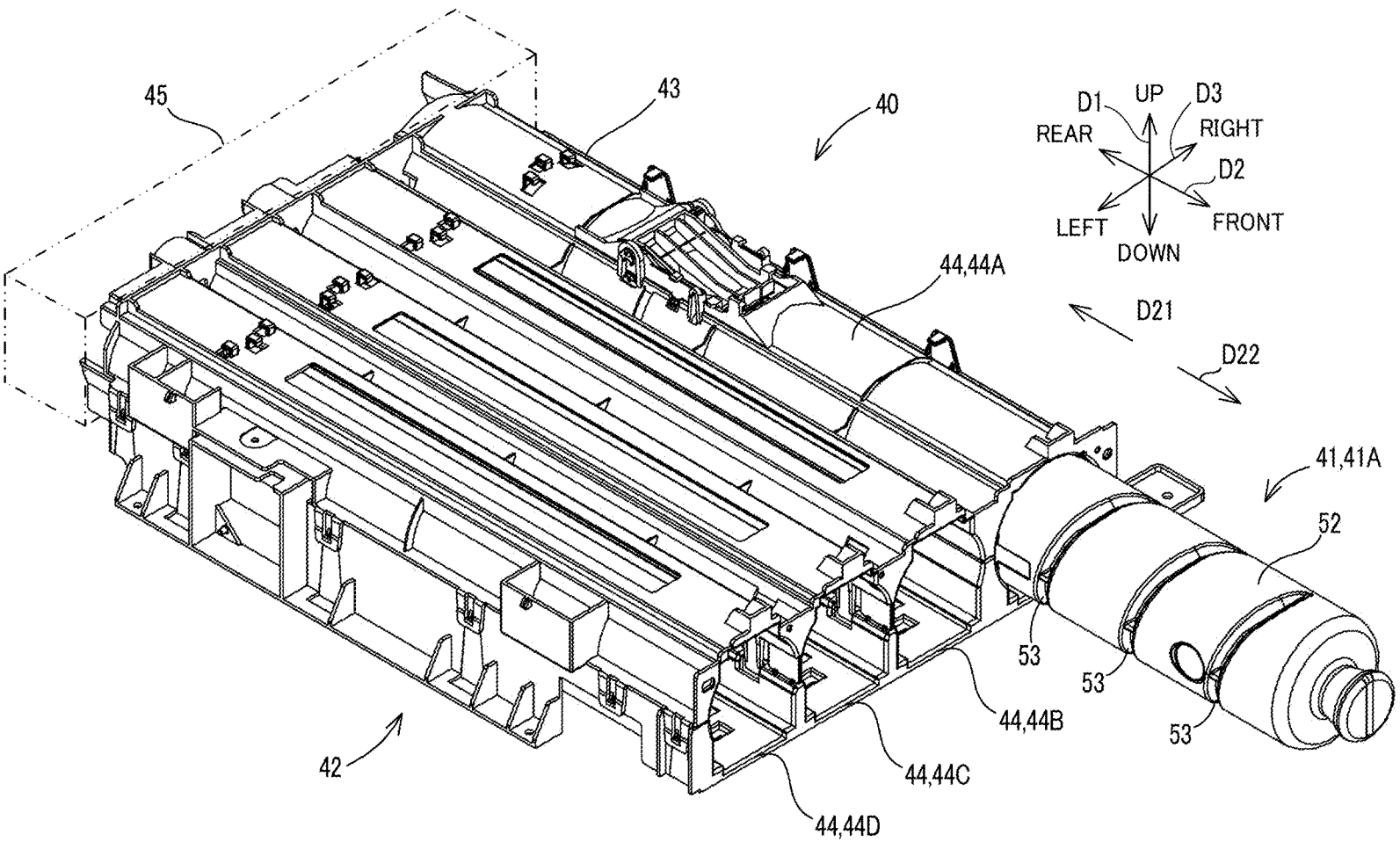
FIG. 2 is a perspective view of a toner supply device included in the image forming apparatus.

In the following, the toner supply device 40 is described with reference to FIG. 2 to FIG. 8B. As shown in FIG. 2, the toner supply device 40 includes the toner containers 41 and the container attachment portion 42 to which the toner containers 41 are attached. It is noted that in the drawings, based on an attachment attitude in which the toner supply device 40 is attached to the housing 11, a vertical direction is defined as the up-down direction D1, the attachment/detachment direction (insertion/removal direction) of the toner containers 41 with respect to the housing 11 is defined as the front-rear direction D2, and a horizontal direction when viewed from the front side of the toner supply device 40 is defined as the left-right direction D3.

The toner containers 41 store toner that is to be supplied to the developing device 23. In the present embodiment, four toner containers 41 corresponding to the colors of black, yellow, cyan and magenta are provided in the toner supply device 40. It is noted that the toner container 41 for black has a larger external diameter than the toner containers 41 for the other colors, but except for this, all the toner containers 41 have the same configuration. In the following description, the toner container 41 refers to the toner container 41 for black unless otherwise mentioned.

Figure 3:
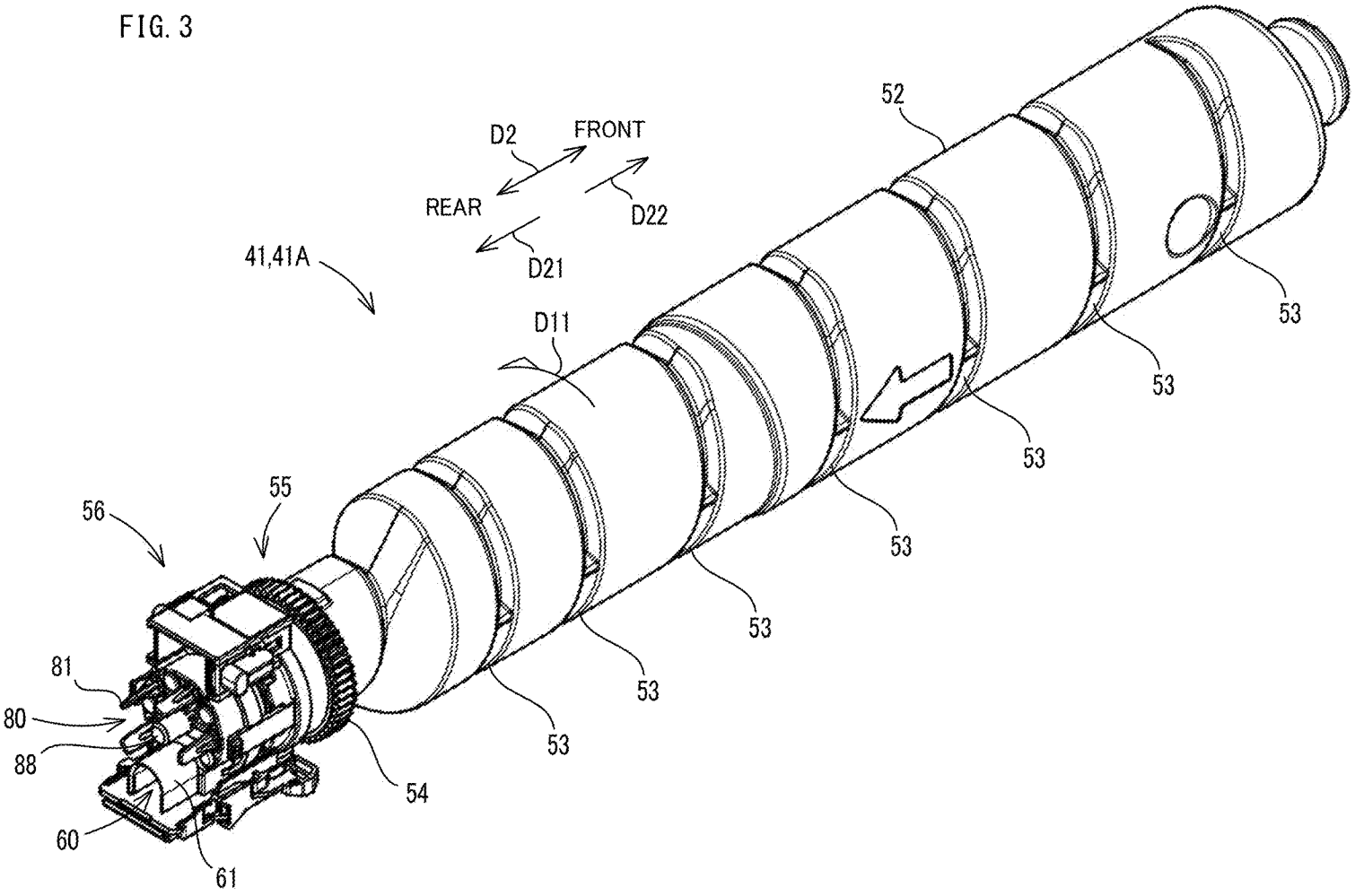
FIG. 3 is a perspective view of a toner container that is attachable to and detachable from the toner supply device.

As shown in FIG. 3, the toner container 41 is elongated in the front-rear direction D2. The toner container 41 includes a container main body 52, a drive transmission portion 55, and a cover member 56. The inside of the container main body 52 is a storage space for storing toner. The toner is stored in the inside of the container main body 52. The container main body 52 has, at one of opposite ends thereof (on the rear side), an opening portion 51 (see FIG. 5) through which the toner can flow in and out. The opening portion 51 is formed at an end of the toner container 41 on an insertion direction D21 side (on the rear side), wherein the toner container 41 is inserted in the toner supply device 40 in the insertion direction D21. The toner stored inside can flow out through the opening portion 51. The container main body 52 is formed in a cylindrical shape with the other end (a front-end side) being closed.

The rear-end portion of the container main body 52 is formed in a tapered shape toward the insertion direction D21 side. The opening portion 51 is formed at a rear end of the container main body 52 on the insertion direction D21 side. The opening portion 51 is circular in a cross section. The container main body 52 is made of, for example, a synthetic resin such as polyethylene terephthalate (PET resin) by the blow molding method or the injection molding method.

The container main body 52 includes an angled rib 53 (see FIG. 3) that is formed in a spiral shape on the inner surface of the container main body 52. The angled rib 53 projects from the inner surface of the container main body 52 toward the center of the container main body 52. The angled rib 53 has a role of conveying the toner in the container main body 52 toward the opening portion 51 (see FIG. 5).

Figure 4:
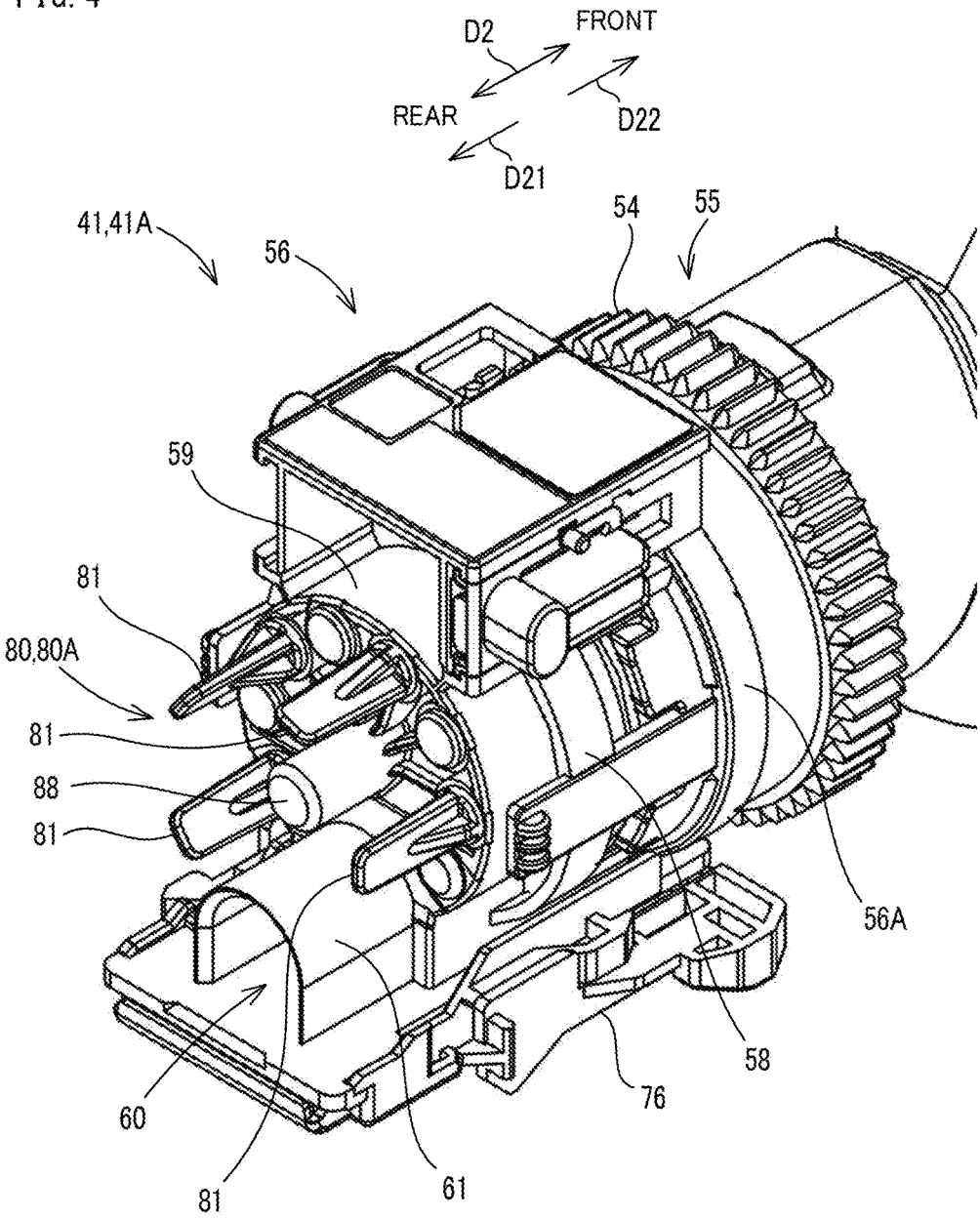
FIG. 4 is an enlarged perspective view of a cover member of the toner container.

As shown in FIG. 4, the drive transmission portion 55 is attached to the opening portion 51 side of the container main body 52. The drive transmission portion 55 is fixed to the container main body 52. The drive transmission portion 55 is an annular member with a gear 54 formed on its circumferential surface. The drive transmission portion 55 is fitted in an end portion of the container main body 52 on the opening portion 51 side, and is fixed to the circumferential surface thereof. Upon receiving a rotational driving force from a drive source such as a motor, the drive transmission portion 55 transmits the rotational driving force to the toner container 41.

In the container main body 52, the cover member 56 is provided more on the insertion direction D21 side (more on the rear side) than the drive transmission portion 55. The cover member 56 is provided to cover the opening portion 51, and is attached to the end portion of the container main body 52 on the insertion direction D21 side. The cover member 56 is a synthetic resin product formed from a synthetic resin having thermoplasticity, by the injection molding or the like.

Figure 5:
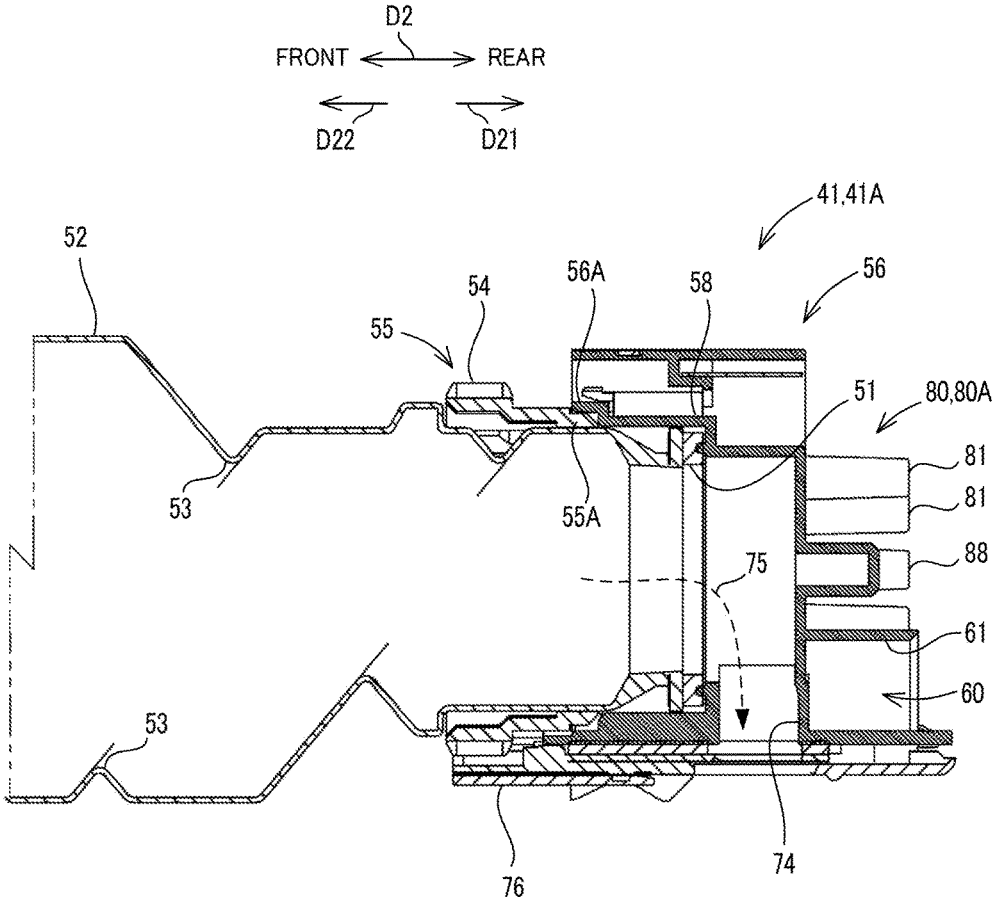
FIG. 5 is a cross-sectional view of the cover member of the toner container.

The cover member 56 includes a storage frame 58 of a cylindrical shape in which the opening portion 51 is inserted in a state where the cover member 56 is attached to the container main body 52 (see FIG. 5). As shown in FIG. 5, the opening portion 51 is inserted in the storage frame 58 so as to be covered therewith. The storage frame 58 supports the opening portion 51 in such a manner that the opening portion 51 can pivot in the circumferential direction. As a result, in the state where the opening portion 51 is inserted in the storage frame 58, the container main body 52 can pivot in the circumferential direction.

When the toner container 41 is attached to the container attachment portion 42 (see FIG. 2), a coupling portion 80 (see FIG. 3) included in the cover member 56 is engaged with a coupled portion 90 (see FIG. 7) included in the container attachment portion 42, and the toner container 41 is attached to the container attachment portion 42, the coupling portion 80 and the coupled portion 90 being described below. With the engagement of the coupling portion 80 and the coupled portion 90, the cover member 56 is fixed in the circumferential direction of the toner container 41. In the present embodiment, in the state where the toner container 41 is attached to the container attachment portion 42, the cover member 56 cannot be rotated in the circumferential direction, while the container main body 52 is supported in the container attachment portion 42 so as to be pivotable in the circumferential direction. A front end portion 56A of the cover member 56 is loosely fitted on a rear end portion 55A of the drive transmission portion 55 (see FIG. 6). As a result, in the state where the toner container 41 is attached to the container attachment portion 42, when the rotational driving force is transmitted to the gear 54, the container main body 52 is rotated in a rotation direction indicated by the arrow D11 (see FIG. 3) by the rotational driving force. That is, the toner container 41 rotates around its longitudinal direction in the state where toner can be supplied to the developing device 23. When the container main body 52 of the toner container 41 rotates in this way, the toner is pressed by the angled rib 53 and conveyed toward the opening portion 51 side (the rear side).

The cover member 56 includes a toner discharge port 74 (see FIG. 5). The toner discharge port 74 is provided to discharge the toner stored in the container main body 52 to the outside, and is provided in the outer circumferential wall of the cover member 56. The toner discharge port 74 is provided below the cover member 56 as shown in FIG. 5. Specifically, the toner discharge port 74 is a rectangular through hole penetrating through the outer circumferential wall of the cover member 56. As shown in FIG. 5, a toner flow path 75 is formed inside the cover member 56 between the opening portion 51 and the toner discharge port 74. When the toner container 41 is attached to the container attachment portion 42 (see FIG. 2) with the toner discharge port 74 on the lower side, the toner, having moved from the opening portion 51 of the container main body 52 to the toner flow path 75, is guided through the toner flow path 75 downward and reaches the toner discharge port 74. Here, when the toner discharge port 74 is opened, the toner is discharged from the toner discharge port 74 to the lower outside. This allows the toner to be supplied to the developing device 23. On the other hand, when the toner discharge port 74 is closed, the toner is not discharged, and the toner flow path 75 is filled with toner.

As shown in FIG. 5, the cover member 56 includes a slide-type opening/closing member 76. The opening/closing member 76 is a plate-like member, and is supported by the cover member 56 in such a way as to be slidable in the longitudinal direction of the container main body 52 (the front-rear direction D2). The opening/closing member 76 opens or closes the toner discharge port 74 depending on the position of the toner container 41 with respect to the container attachment portion 42. When the toner container 41 is attached to the container attachment portion 42, the opening/closing member 76 opens the toner discharge port 74. Specifically, when the toner container 41 is attached to the container attachment portion 42, the opening/closing member 76 receives a pressing force of the attachment operation from the container attachment portion 42, and is moved to a position (opening position) where the opening/closing member 76 opens the toner discharge port 74. FIG. 5 shows a state where the opening/closing member 76 has moved to the front side and opened the toner discharge port 74. When the toner container 41 is pulled out in a removal direction D22 (see FIG. 2) and removed from the container attachment portion 42, the opening/closing member 76 moves rearward with the removal operation from the opening position to a position (closing position) where the toner discharge port 74 is closed, and the opening/closing member 76 closes the toner discharge port 74. It is noted that the container attachment portion 42 includes a biasing member (not illustrated), and the movement of the opening/closing member 76 from the opening position to the closing position is realized as the biasing member causes the opening/closing member 76 to move relatively rearward in response to the removal operation of the toner container 41.

As shown in FIG. 4, the cover member 56 includes a base portion 59 more on the insertion direction D21 side than the storage frame 58, wherein the base portion 59 is cylindrical and hollow inside. The base portion 59 is integrally formed with the coupling portion 80 (an example of the attaching portion of the present disclosure) that is described later. On an end surface 59A of the base portion 59 on the insertion direction D21 side, an arch-shaped guide wall 61 is provided so as to project from the end surface 59A. The guide wall 61 is provided at the center of a lower end portion of the end surface 59A. A hole 60 surrounded by the guide wall 61 is a portion in which a coil spring (not illustrated) of the container attachment portion 42 is inserted when the toner container 41 is attached to one of storage portions 44 (see FIG. 2) that are described below.

In addition, a projection 88 (an example of the engaging portion of the present disclosure) is integrally formed with the end surface 59A at the center of the end surface 59A. The projection 88 is engaged with a hole 94A of a protruding boss 94 (an example of the engaged portion of the present disclosure) provided on a coupling supporting portion 45 of the container attachment portion 42, when the toner container 41 is attached to one of the storage portions 44. Specifically, the projection 88 is inserted in the hole 94A. This allows the projection 88 and the protruding boss 94 to be engaged with each other, and the toner container 41 is positioned to an attachment position defined in the storage portion 44. It is noted that, when the toner container 41 is attached to the storage portion 44, the coil spring is inserted, in the state of being contracted, in the hole 60. Thus, the toner container 41 is locked at the attachment position of the storage portion 44 by a locking mechanism (not illustrated) so that the toner container 41 is not released by the spring force of the coil spring.

As shown in FIG. 2, the container attachment portion 42 includes a storage case 43 and the coupling supporting portion 45. The storage case 43 includes four storage portions 44 (44A to 44D). The coupling supporting portion 45 is attached to the rear end surface of the storage case 43. It is noted that in FIG. 2, the coupling supporting portion 45 is represented by a two-dot chain line.

The storage portions 44 respectively store the toner containers 41 of predetermined colors. The rightmost storage portion 44A stores the toner container 41 for black. FIG. 2 shows a state where a part of the rear-side portion of the toner container 41 for black is inserted in the storage portion 44. The storage portions 44B, 44C and 44D disposed on the left side of the storage portion 44A store toner containers 41 for yellow, cyan and magenta, respectively.

The coupling supporting portion 45 is provided so as to position the toner containers 41 to the attachment positions in the storage portions 44 by being coupled with the toner containers 41 attached to the storage portions 44. The coupling supporting portion 45 is provided independently of the storage case 43, and is attached to the storage case 43 or to an inner frame provided in the housing 11. The coupling supporting portion 45 includes four coupled portions 90 (an example of the coupled portion of the present disclosure) in correspondence with the four storage portions 44. It is noted that the container attachment portion 42 may be composed of the coupling supporting portion 45 and the storage case 43 that are integrally formed with each other.

In the present embodiment, the image forming apparatus 10 is configured such that a toner container 41 unsuitable to the image forming apparatus 10 cannot be attached thereto. That is, the image forming apparatus 10 is configured such that only a toner container 41 having attachment compatibility with a storage portion 44 can be attached to the storage portion 44. In other words, each storage portion 44 selectively allows a toner container 41 having attachment compatibility therewith to be attached thereto. For this purpose, in the present embodiment, the coupling portion 80 is provided on a tip of the toner container 41 on the insertion direction D21 side, and the coupled portion 90 is provided on the coupling supporting portion 45. When a toner container 41 is inserted in a storage portion 44, and the coupling portion 80 of the toner container 41 is engaged with the coupled portion 90, the attachment of the toner container 41 is permitted. On the other hand, when the coupling portion 80 of the toner container 41 is not engaged with the coupled portion 90, the attachment of the toner container 41 is prohibited. Such a configuration for realizing the attachment compatibility between the coupled portion 90 and the coupling portion 80 is referred to as an incompatibility structure, in general.

In the following, the configuration of the coupling portion 80 is described.

As shown in FIG. 4, the coupling portion 80 is provided on the end surface 59A of the base portion 59 of the cover member 56. Here, FIG. 4 shows the tip of the toner container 41 for black that is inserted in the storage portion 44A corresponding to black. Hereinafter, for explanation's sake, the toner container 41 for black is referred to as a toner container 41A, and the coupling portion 80 provided in the toner container 41A is referred to as a coupling portion 80A. The coupling portion 80A is provided on the tip of the toner container 41A on the insertion direction D21 side. The coupling portion 80 is provided not only in the toner container 41A for black, but also in each of the toner containers 41 for yellow, cyan, and magenta, and those coupling portions 80 are formed in the same shape. In the following, as the representative of the coupling portions 80 for different colors, the coupling portion 80A for black is described with reference to FIG. 4.

As shown in FIG. 4, the coupling portion 80A is integrally provided with the cover member 56 of the toner container 41A. As described above, the cover member 56 includes the base portion 59 that is cylindrical and hollow inside. The coupling portion 80A is provided on the end surface 59A of the base portion 59. The coupling portion 80A is integrally formed with the cover member 56 when the cover member 56 is molded.

The coupling portion 80A includes four compatible keys 81 (an example of the second key member of the present disclosure). The four compatible keys 81 are positioned so as to be engaged with the coupled portion 90A for black. The compatible keys 81 are protruding members that project from the end surface 59A in the insertion direction D21 (namely, toward the coupled portion 90A), and each of the compatible keys 81 has a flat tip. The compatible keys 81 are made of insulator that does not allow electricity to pass through it. The four compatible keys 81 are formed at positions where they do not interfere with interference keys 101 (see FIG. 8A, an example of the first key member of the present disclosure) that are provided on the coupled portion 90, in the attachment state where the toner container 41A is attached to the storage portion 44A of the container attachment portion 42.

Figure 6:
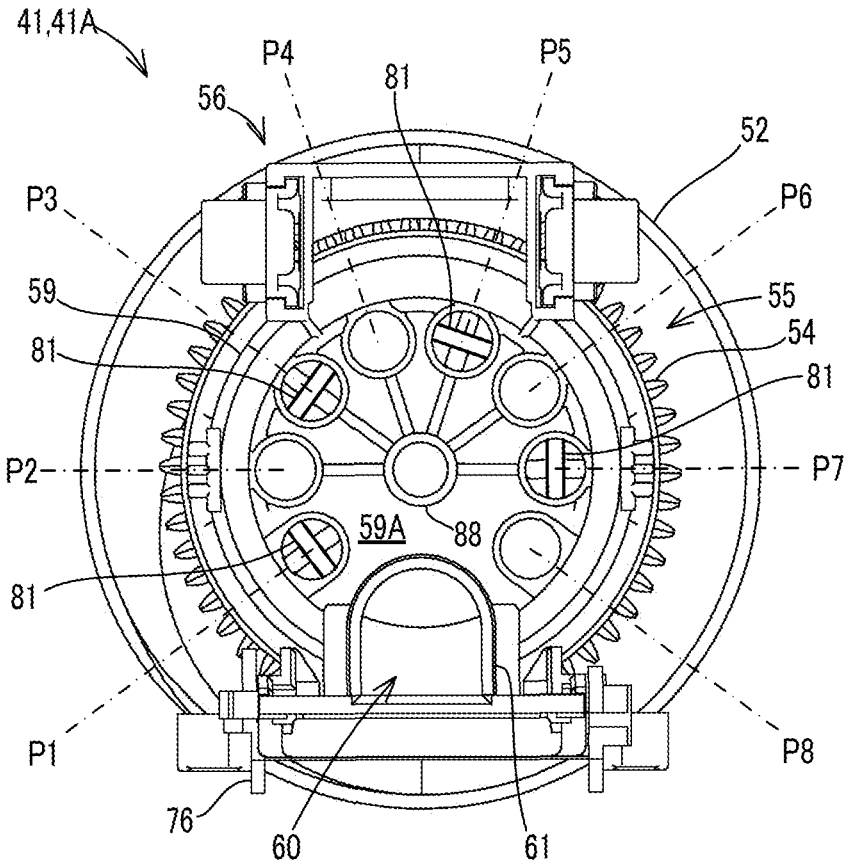
FIG. 6 is a front view of the cover member of the toner container.

In the present embodiment, as the positions on which the compatible keys 81 can be disposed, the positions P1 to P8 are defined on the circumference of a circle arranged around the projection 88, as shown in FIG. 6. The positions P1 to P8 are the same positions in each of the coupling portions 80 of the toner containers 41, and are defined on the circumference at an equal angle interval based on the projection 88. That is, the positions P1 to P8 are arranged to form an arc shape along the circumference in the coupling portion 80A. In the example shown in FIG. 6, on the end surface 59A, the position P1 is defined to be adjacent to the guide wall 61 in the CW (clockwise) direction, and the positions P2 to P8 are defined at an equal angle interval from the position P1 in the CW direction. As shown in FIG. 6, the positions P1 to P8 are arranged symmetrically with respect to a vertical line passing through the center of the projection 88. In the toner container 41A, the four compatible keys 81 are provided at positions P1, P3, P5 and P7 among the positions P1 to P8. In other words, the four compatible keys 81 are arranged to form an arc shape on the end surface 59A of the coupling portion 80A.

In the following, configurations of the coupling supporting portion 45 and the coupled portion 90 are described.

Figure 7:
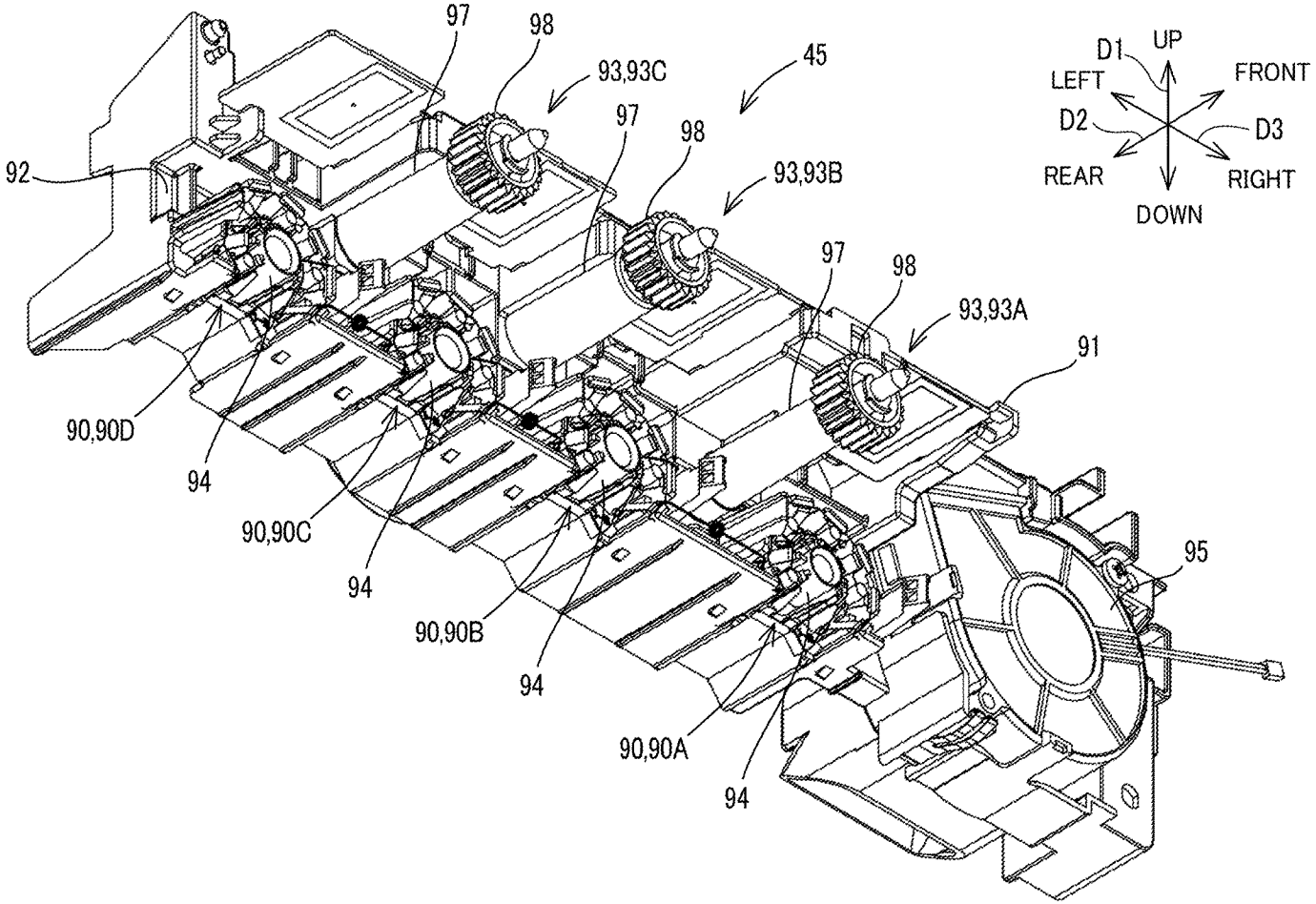
FIG. 7 is a perspective view of a coupling supporting portion included in the toner supply device.

As shown in FIG. 7, the coupling supporting portion 45 includes a frame 91 that can be attached to the rear end surface of the storage case 43. The frame 91 is elongated in the left-right direction D3. On an attachment surface 92 of the frame 91 in its front side, four coupled portions 90 (90A to 90D), three drive transmission portions 93 (93A to 93C), and a blower fan 95 are attached.

The four coupled portions 90 are aligned on a straight line in the longitudinal direction of the frame 91. The rightmost coupled portion 90A is coupled with the toner container 41 for black. The coupled portions 90B, 90C, and 90D disposed on the left side of the coupled portion 90A are, respectively, coupled with the toner containers 41 for yellow, cyan, and magenta.

Each of the drive transmission portions 93 receives a rotational driving force from a drive source such as a motor in the housing 11, and transmits the rotational driving force to the gear 54 of the toner container 41. Each of the drive transmission portions 93 includes a support portion 97 and a gear 98, wherein the support portion 97 is cylindrical and projects vertically from the attachment surface 92, and the gear 98 is rotationably supported by the support portion 97.

The drive transmission portion 93A is provided in the vicinity of the coupled portion 90A, and in a state where the toner container 41 for black is attached to the storage portion 44A, the gear 98 of the drive transmission portion 93A is coupled with the gear 54. The drive transmission portion 93B is provided in the vicinity of the coupled portion 90B, and in a state where a toner container 41 is attached to the storage portion 44B, the gear 98 of the drive transmission portion 93B is coupled with the gear 54. The drive transmission portion 93C is provided between the coupled portion 90C and the coupled portion 90D, and in a state where toner containers 41 are respectively attached to the storage portion 44C and the storage portion 44D, the gear 98 of the drive transmission portion 93C is coupled with the gears 54 of the toner containers 41.

Figure 8A:
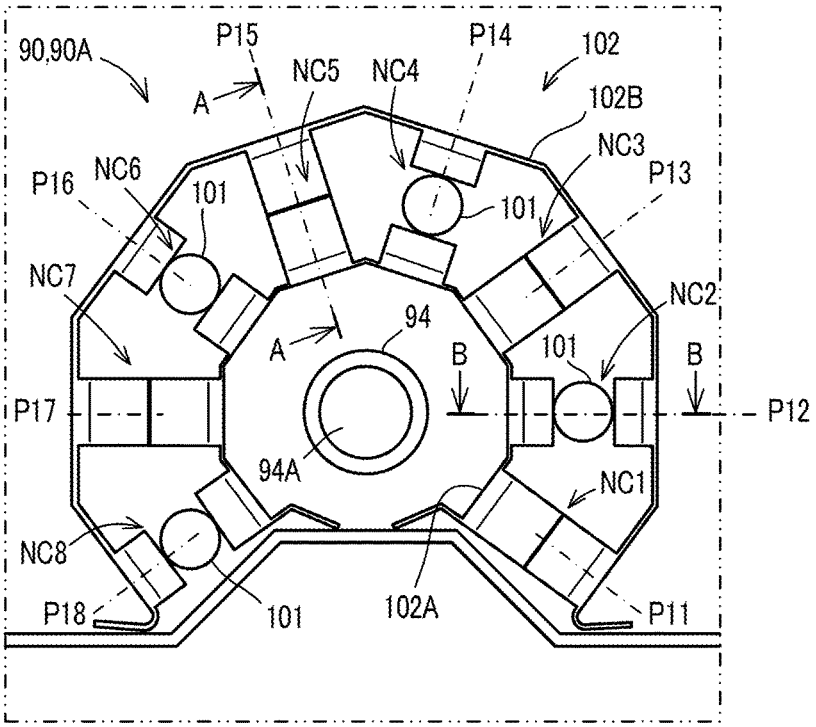
FIG. 8A and FIG. 8B are schematic diagrams showing a coupled portion included in the coupling supporting portion.
Figure 8B:
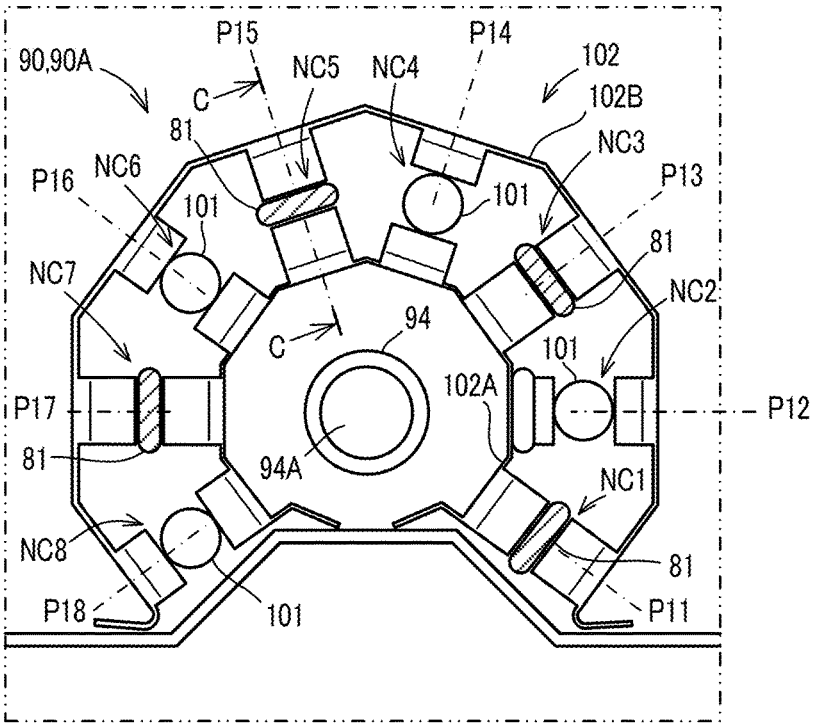

FIG. 8A and FIG. 8B are schematic diagrams showing the coupled portion 90A included in the coupling supporting portion 45, and are front views of the coupled portion 90A. Since the four coupled portions 90 (90A to 90D) have the same shape and configuration, in the following, the coupled portion 90A for black is described as the representative of the coupled portions 90 for different colors. As shown in FIG. 8A, the coupled portion 90A includes four interference keys 101, a contact terminal 102 (an example of the contact terminal of the present disclosure), and the protruding boss 94.

As shown in FIG. 8A, the protruding boss 94 of a circular shape is provided at the center of the coupled portion 90A. The protruding boss 94 is a cylindrical member protruding from the attachment surface 92 toward the toner container 41A (frontward). A hole 94A is formed at the center of the front end surface of the protruding boss 94. The hole 94A is a portion into which the projection 88 for positioning is inserted, wherein the projection 88 is provided on the end surface 59A of the cover member 56.

The interference keys 101 are provided at any of the eight positions (P11 to P18) predefined on the coupled portion 90A. The interference keys 101 are bar-like members that project from the attachment surface 92 toward the toner container 41A (frontward).

The positions P11 to P18 are defined on a circumference of a circle arranged around the protruding boss 94. That is, the positions P11 to P18, as the positions P1 to P8, are arranged to form an arc shape along the circumference in the coupled portion 90A. In the present embodiment, the positions P11 to P18 are the same positions in each of the four coupled portion 90, and are defined on the circumference at an equal angle interval based on the center. In the example shown in FIG. 8A and FIG. 8B, on the attachment surface 92, the position P11 is defined in correspondence with the position P1 on the end surface 59A of the cover member 56, and the positions P12 to P18 are defined at an equal angle interval from the position P11 in a CCW (counterclockwise) direction. As shown in FIG. 8A, the positions P11 to P18 are arranged symmetrically with respect to a vertical line passing through the center of the protruding boss 94. When the toner container 41A is attached to the storage portion 44A, the position P1 faces the position P11, and the position P2 faces the position P12. In addition, the positions P3 to P8 face the positions P13 to P18, respectively.

In the present embodiment, on the coupled portion 90A, the four interference keys 101 are provided at positions where they do not interfere with the compatible keys 81, namely, at positions P12, P14, P16 and P18 among the positions P11 to P18. In other words, the four interference keys 101 are arranged to form an arc shape on the attachment surface 92 of the coupled portion 90A. With this configuration, as shown in FIG. 8B, when the toner container 41A having attachment compatibility with the coupled portion 90A is inserted in the storage portion 44A, the compatible keys 81 are disposed at the positions P11, P13, P15 and P17 at which no interference key 101 is provided. This makes it possible to attach the toner container 41A to the storage portion 44A, without causing the interference keys 101 to hinder the attachment of the toner container 41A.

It is noted that if a toner container 41 that has a compatible key 81 at any of the positions P1, P3, P5 and P7, is inserted in the storage portion 44A, the tip of the compatible key 81 abuts on any of the interference keys 101. This prevents a further insertion of the toner container 41, and the attachment of the toner container 41 to the storage portion 44A is hindered. That is, such a toner container 41 does not have attachment compatibility with the storage portion 44A.

Meanwhile, there may be a case where a toner container 41 having no attachment compatibility with the storage portion 44A is inserted to the attachment position in the storage portion 44A. For example, there may be a case where the compatible keys 81 for realizing the incompatibility structure are lost due to breakage or the like, and a toner container 41 having no compatible key 81 is inserted in the container attachment portion 42. When this happens, the interference keys 101 cannot interfere with the toner container 41, and the attachment of the toner container 41 not having the attachment compatibility is permitted. In this case, the image forming apparatus 10 cannot determine whether the toner container 41 is an inappropriate toner container including inappropriate toner, or a normal toner container. If the image forming operation is performed while an inappropriate toner container is attached, inappropriate toner is supplied to the developing device 23, resulting in a defective printing. In addition, in case of a configuration where toner containers 41 for different colors do not have an attachment compatibility, if a toner container 41 for a color having no compatible key 81 is inserted in a storage portion 44 for another color, the toner container 41 is permitted to be in the storage portion 44. In this case, too, if the image forming operation is performed in this state, toner of a different color is supplied to the developing device 23, resulting in a defective printing. To solve these problems, in the image forming apparatus 10, the attachment compatibility of the toner container 41 with the container attachment portion 42 is realized, and the toner container 41 attached to the container attachment portion 42 is detected by using the compatible keys 81 that realize the attachment compatibility. In other words, in the image forming apparatus 10, when a toner container 41 having no compatible key 81 is disposed at the attachment position of the storage portion 44A, the control portion 8 cannot detect the toner container 41.

In the present embodiment, to enable the control portion 8 to detect the toner container 41A in the storage portion 44A, the contact terminal 102 is provided on the coupled portion 90A. The contact terminal 102 is formed by processing a metal plate having conductivity. The contact terminal 102 is composed of a pair of metal terminals 102A and 102B. The metal terminal 102A is disposed on the protruding boss 94 side on the coupled portion 90A, and is supported by a support piece (not shown) provided on the attachment surface 92. The metal terminal 102B is disposed outside the metal terminal 102A to face the metal terminal 102A, and is supported by a support piece (not shown) provided on the attachment surface 92.

Figure 9A:
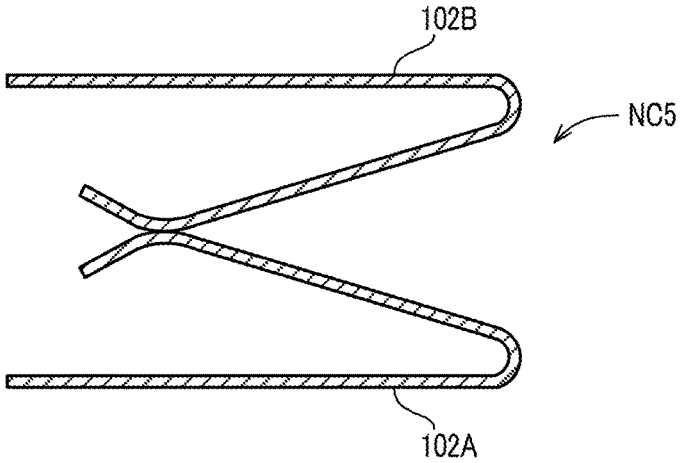
FIG. 9A is a cross-sectional view taken along a cut line A-A shown in FIG. 8A.

The contact terminal 102 includes eight contacts NC (NC1 to NC8). In a normal time, each of the contacts NC is closed by a spring force generated by metal plates (see FIG. 9A). It is noted that FIG. 9A shows the contact NC5 in a normal state. As described below, the contact terminal 102 is configured to be opened upon receiving an external force in a direction of opening each contact NC.

Figure 9B:
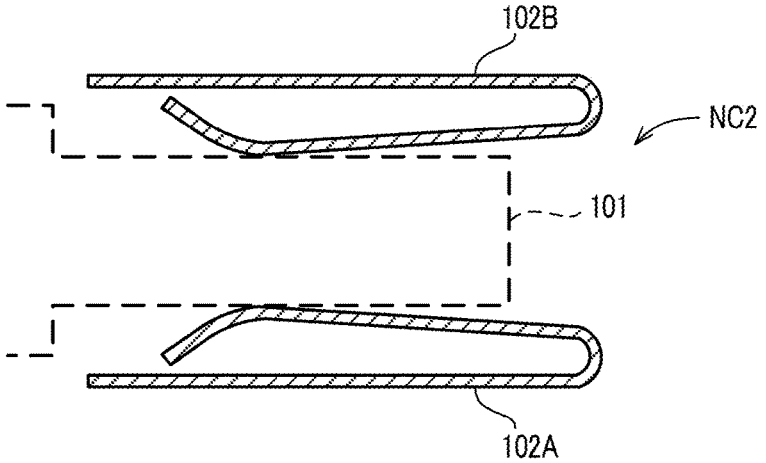
FIG. 9B is a cross-sectional view taken along a cut line B-B shown in FIG. 8A.

In the contact terminal 102, the contacts NC1 to NC8 correspond to positions P11 to P18, respectively. Specifically, the contact NC1 is disposed in correspondence with the position P11, and the contacts NC2 to NC8 are disposed at an equal angle interval from the position of the contact NC1 in a CCW (counterclockwise) direction. The contact terminal 102 is supported not only by the support pieces, but also by the interference keys 101 on the coupled portion 90A. Specifically, the contact NC2 is inserted around the interference key 101 at the position P12 (see FIG. 9B). It is noted that FIG. 9B shows a state where the contact NC2 is inserted around the interference key 101, and the contact NC2 is opened. In addition, the contact NC4 is inserted around the interference key 101 at the position P14, the contact NC6 is inserted around the interference key 101 at the position P16, and the contact NC8 is inserted around the interference key 101 at the position P18. In this way, when the contacts NC2, NC4, NC6 and NC 8 are inserted around the interference keys 101, each of the contacts NC2, NC4, NC6, and NC 8 holds the interference key 101 by a spring force in a closing direction.

Figure 9C:
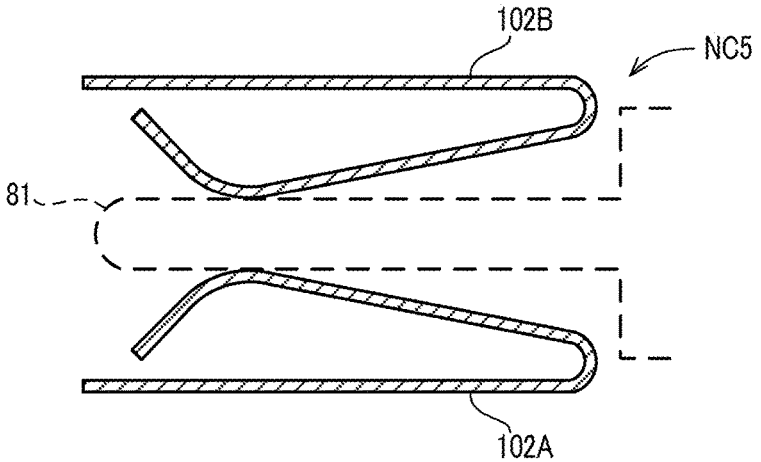
FIG. 9C is a cross-sectional view taken along a cut line C-C shown in FIG. 8B.

In a state where the contact terminal 102 is mounted on the coupled portion 90A, when the toner container 41A is attached to the storage portion 44A, the tips of the compatible keys 81 abut on corresponding contacts NC of the contact terminal 102 before the toner container 41A reaches the attachment position. When the toner container 41A is further inserted into the storage portion 44A, the tips of the compatible keys 81 enter the contacts NC, and open the contacts NC. Specifically, when the toner container 41A is attached to the storage portion 44A, four compatible keys 81 enter the contacts NC1, NC3, NC5 and NC7, and open the contacts (see FIG. 9C). It is noted that FIG. 9C shows a state where the compatible key 81 has entered the contact NC5 and the contact NC5 is opened.

Figure 10:
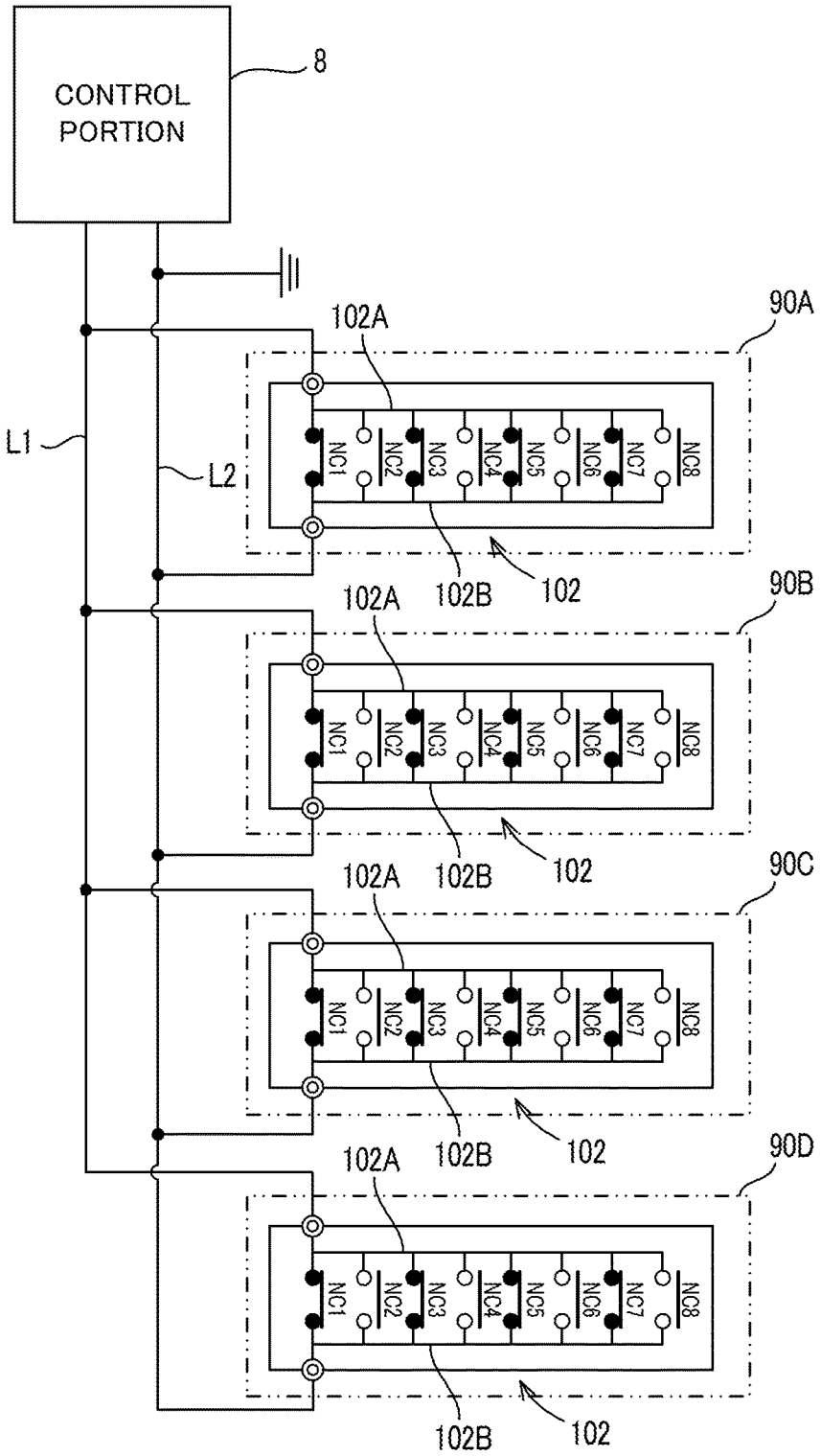
FIG. 10 is a circuit connection diagram of contact terminals and a control portion.

Four contact terminals 102 respectively provided on four coupled portions 90 are connected by a signal line L1 and a ground line L2. Specifically, as shown in FIG. 10, the metal terminals 102A of the contact terminals 102 are connected with each other by a common signal line L1. In addition, the metal terminals 102A of the contact terminals 102 are connected with each other by a common ground line L2. The signal line L1 is connected to the control portion 8. In addition, the ground line L2 is connected to the control portion 8 in a state where the ground line L2 is grounded to have a reference potential (for example, the earth potential). The control portion 8 applies voltage of a predetermined voltage value to the signal line L1. The control portion 8 measures the voltage between the signal line L1 and the ground line L2, and determines whether or not the signal line L1 and the ground line L2 are conducted to each other depending on whether or not the measured value is the reference potential.

With the above-described configuration of the coupled portion 90, in the present embodiment, in a case where no toner container 41 is attached to any of the four storage portions 44, the contacts NC are in a state shown in FIG. 10, namely, in a state where part of the contacts NC is closed to be in an ON state, and the control portion 8 determines that the signal line L1 and the ground line L2 are conducted to each other. In this case, the control portion 8 cannot detect a toner container 41 in the storage portions 44, and determines that the storage portions 44 are in an unattachment state where no toner container 41 is attached. In this case, the control portion 8 displays a message on the liquid crystal display portion of the operation/display portion 9, wherein the message indicates that no toner container 41 has been attached, or urges the user to attach the toner container 41.

Figure 11A:
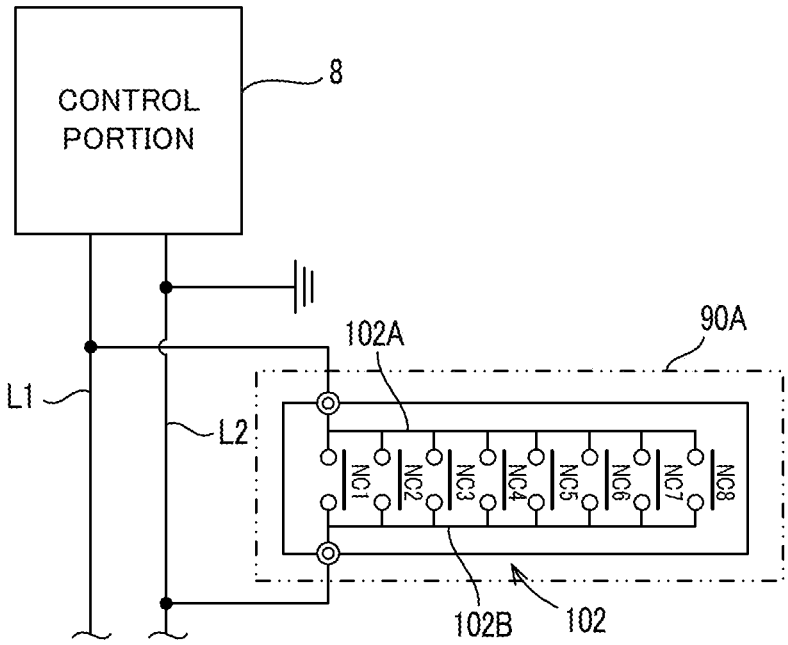
FIG. 11A and FIG. 11B are diagrams showing operation states of contacts of contact terminals.

In addition, in a case where normal toner containers 41 are attached to all of the four storage portions 44, the contacts NC are in a state shown in FIG. 11A, namely, in a state where all contacts NC are opened to be in an OFF state. When all the contacts NC are in the OFF state, the control portion 8 determines that the signal line L1 and the ground line L2 are not conducted to each other. In this case, the control portion 8 determines that normal toner containers 41 have been attached to the storage portions 44. That is, the control portion 8 detects the toner containers 41 disposed at the attachment positions of the storage portions 44. The control portion 8 then stops displaying the message on the liquid crystal display portion of the operation/display portion 9, and makes the image forming operation in the image forming apparatus 10 executable. It is noted that FIG. 11A shows a state of the contact terminal 102 of the coupled portion 90A, and omits the states of the other contact terminals 102.

Figure 11B:
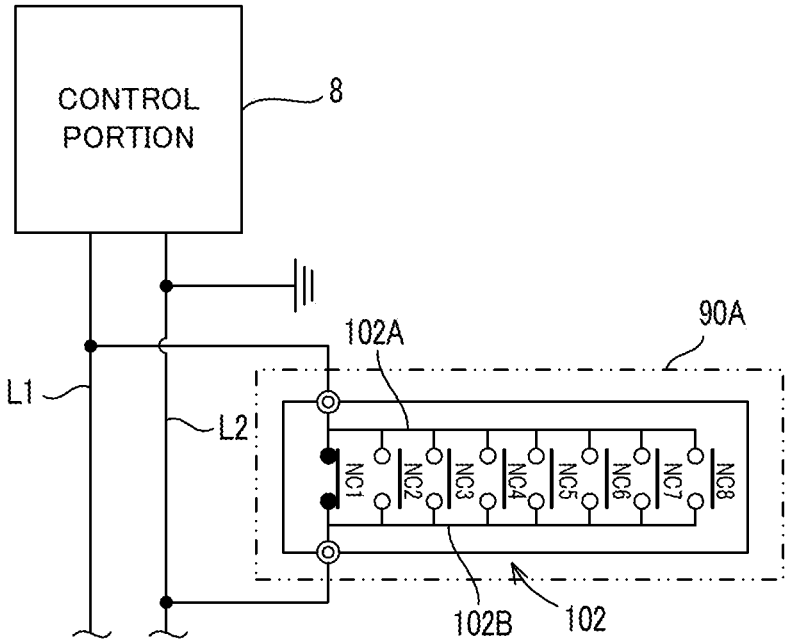

When an inappropriate toner container 41 is attached to the storage portion 44A among the four storage portions 44, only part of the contacts NC of the contact terminal 102 of the coupled portion 90A, is closed to be in the ON state. For example, when a toner container 41 lacking a compatible key 81 at the position P1 is attached to the storage portion 44A, only the contact NC1 maintains the ON state, and the other contacts NC are opened and become the OFF state, as shown in FIG. 11B. In this case, since the contact NC1 is in the ON state, the signal line L1 and the ground line L2 are conducted to each other. In this case, the control portion 8 cannot detect the toner container 41 even if the toner container 41 is attached to the storage portion 44A. That is, even when the toner container 41 is actually attached, the control portion 8 determines that the storage portion 44A is in the unattachment state where no toner container 41 is attached. As a result, determining that a toner container 41 is not attached, the control portion 8 continues to display the message on the liquid crystal display portion of the operation/display portion 9. In this case, the worker who has attached the toner container 41 recognizes that the attached toner container 41 is or may be inappropriate for the image forming apparatus 10, by confirming that the message has been displayed continuously.

The above-described configuration makes it possible to realize the incompatibility structure using the compatible keys 81 and the interference keys 101, and makes it possible to detect a toner container 41 in the storage portions 44 easily by using the compatible keys 81 that realize the incompatibility structure. Furthermore, it is possible to detect an inappropriate toner container 41 in the storage portions 44. In addition, when an inappropriate toner container 41 is attached, the message is continuously displayed on the liquid crystal display portion of the operation/display portion 9. This makes it possible for the worker who has attached the toner container 41, to recognize that the attached toner container 41 is an inappropriate one, and check and remove the inappropriate toner container 41 before the image forming operation is performed. This eliminates supply of inappropriate toner to the image forming portions 1 to 4, and prevents defective printing from occurring.

It is noted that in the above-described embodiment, the toner container 41 including four compatible keys 81 and the coupled portion 90 including four interference keys 101 are described as one example. However, the number and/or positions of the compatible keys 81 and the interference keys 101 are not limited to those described above.

In addition, in the above-described embodiment, it is described as one example that the coupling portion 80 is provided on the cover member 56. However, for example, when the toner container 41 does not include the cover member 56, the coupling portion 80 may be integrally formed with the container main body 52 of the toner container 41.

In addition, in the above-described embodiment, it is described as one example that the contact terminals 102 respectively provided on the coupled portions 90 are connected by a common signal line L1 and a common ground line L2. However, for example, the contact terminals 102 may be connected by individual signal lines. In this case, although the number of signal lines increases, detections of toner containers 41 in the four storage portions 44 can be performed independently and individually.

It is noted that, in the above-described embodiment, as one embodiment of the present disclosure, the image forming apparatus 10 including the toner container 41 and the container attachment portion 42 is described. However, the toner container 41 configured to be attachable to and detachable from the container attachment portion 42 can be considered as another aspect of the present disclosure. Since the toner container 41 is configured as described above, when a toner container 41 having attachment compatibility is attached to the container attachment portion 42, the image forming apparatus 10 can detect the attachment and perform the image forming operation. In addition, when a toner container 41 not having attachment compatibility is attached, the image forming apparatus 10 cannot detect the attachment and displays a message indicating the unattachment state continuously on the liquid crystal display portion of the operation/display portion 9. Upon confirming the message, the worker can remove the inappropriate toner container 41 before the image forming operation is performed.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a toner container having a coupling portion on a tip thereof, a container attachment portion configured to support the toner container such that the toner container is inserted toward a predetermined attachment position and is attached thereto at the attachment position; and a control portion configured to, upon detection of the toner container attached to the container attachment portion, make an image forming operation executable, wherein the container attachment portion includes a coupled portion that includes at least one first key member that protrudes toward the toner container, the coupling portion includes at least one second key member formed at a position where it does not interfere with the first key member in an attachment state where the toner container is attached to the container attachment portion, the second key member being made of an insulator and projecting in an insertion direction directing toward the attachment position, the coupled portion includes a contact terminal in which a contact is opened by the second key member and becomes an OFF state when the toner container is inserted to the attachment position, and the contact is closed and becomes an ON state when the toner container is removed from the attachment position, and the control portion detects the toner container attached to the container attachment portion when the contact of the contact terminal changes from the ON state to the OFF state.

2. The image forming apparatus according to claim 1, wherein a plurality of the second key members are provided on the coupling portion, a plurality of the contact terminals are provided on the coupled portion in correspondence with the plurality of the second key members, and the control portion detects the toner container attached to the container attachment portion when all the contacts of the plurality of the contact terminals change from the ON state to the OFF state.

3. The image forming apparatus according to claim 1, wherein the coupled portion includes an engaged portion around which the first key member is disposed, the coupling portion includes an engaging portion configured to be engaged with the engaged portion in the attachment state, and when the toner container is inserted to the attachment position, the engaging portion is engaged with the engaged portion such that the toner container is positioned with respect to the container attachment portion.

4. The image forming apparatus according to claim 1, wherein the container attachment portion includes a plurality of storage portions to which a plurality of the toner containers respectively corresponding to a plurality of colors, can be selectively attached, respectively, a plurality of the coupled portions respectively corresponding to the plurality of colors are provided in the plurality of storage portions, respectively, and the control portion detects the plurality of the toner containers attached to the plurality of storage portions when the contacts of the contact terminals of the coupled portions respectively provided in the plurality of storage portions change from the ON state to the OFF state.

5. The image forming apparatus according to claim 4, wherein when a toner container is inserted in a storage portion that does not correspond to the toner container, the second key member interferes with the first key member and the toner container cannot be attached to the storage portion, and when a toner container lacking the second key member is inserted in a storage portion that does not correspond to the toner container, an interference by the first key member is not made and the toner container can be attached to the storage portion.

6. A toner container configured to be attachable to and detachable from a container attachment portion of an image forming apparatus, wherein the container attachment portion includes a storage portion, a coupled portion, and a contact terminal, the storage portion storing the toner container that is inserted toward a predetermined attachment position, the coupled portion including at least one first key member that protrudes toward the toner container, the contact terminal being provided on the coupled portion and in a normal time, a contact of the contact terminal being closed and maintaining an ON state, the toner container includes a coupling portion that is engaged and coupled with the coupled portion at the attachment position, the coupling portion includes at least one second key member that is formed at a position where it does not interfere with the first key member in an attachment state where the toner container is attached to the container attachment portion, the second key member being made of an insulator and projecting in an insertion direction directing toward the attachment position, and when the toner container is inserted to the attachment position, the contact is opened by the second key member and becomes an OFF state, and when the toner container is removed from the attachment position, the contact is closed and becomes an ON state.

7. The toner container according to claim 6, wherein a plurality of the second key members are arranged to form an arc shape on the coupling portion, a plurality of the contact terminals are arranged to form an arc shape on the coupled portion in correspondence with the second key members, and when the toner container is attached to the container attachment portion, all the contacts of the plurality of the contact terminals change from the ON state to the OFF state.

* * * * *